US012735650B2

(12) United States Patent
Wang et al.

(10) Patent No.: US 12,735,650 B2
(45) Date of Patent: Sep. 15, 2026

(54) DRYING FURNACE DEVICE OF GASIFIER CAPABLE OF AUTOMATICALLY ADJUSTING TEMPERATURE

(71) Applicant: ANHUI UNIVERSITY OF SCIENCE & TECHNOLOGY, Huainan (CN)

(72) Inventors: Changji Wang, Huainan (CN); Hanxu Li, Huainan (CN); Lei Zhang, Huainan (CN); Jian Li, Huainan (CN); Yuanyuan Zhu, Huainan (CN); Jian He, Huainan (CN); Ming Liu, Huainan (CN)

(73) Assignee: ANHUI UNIVERSITY OF SCIENCE & TECHNOLOGY, Huainan (CN)

( * ) Notice: Subject to any disclaimer, the term of this patent is extended or adjusted under 35 U.S.C. 154(b) by 526 days.

(21) Appl. No.: 18/484,611

(22) Filed: Oct. 11, 2023

(65) Prior Publication Data

US 2024/0034947 A1 Feb. 1, 2024

Related U.S. Application Data

(63) Continuation of application No. PCT/CN2023/094787, filed on May 17, 2023.

(30) Foreign Application Priority Data

May 17, 2022 (CN) ..... 202210534546.X

(51) Int. Cl.
*C10J 3/72* (2006.01)
*C10J 3/32* (2006.01)
(Continued)

(52) U.S. Cl.
CPC ..... *C10J 3/723* (2013.01); *C10J 3/32* (2013.01); *C10J 3/74* (2013.01); *C10J 3/82* (2013.01);
(Continued)

(58) Field of Classification Search
CPC ..... C10J 3/26; C10J 3/56; C10J 3/20; C10J 3/48; C10J 2300/093; C10J 2200/09;
(Continued)

(56) References Cited

U.S. PATENT DOCUMENTS 3,049,342 A * 8/1962 Hansen ..... F02M 7/16 261/50.1
3,950,147 A * 4/1976 Funk ..... C10J 3/485 110/238
(Continued)

FOREIGN PATENT DOCUMENTS

CN 201180999 Y 1/2009
CN 202379960 U 8/2012
(Continued)

*Primary Examiner* — Imran Akram
(74) *Attorney, Agent, or Firm* — Pilloff Passino & Cosenza LLP; Rachel K. Pilloff; Sean A. Passino

(57) ABSTRACT

A drying furnace device of a gasifier capable of automatically adjusting temperatures includes a gasifier and a drying furnace assembly. The gasifier includes a furnace wall. A top of the furnace wall is provided with a coal inlet, a top side of the furnace wall is provided with a gas outlet, and an outside of a bottom of the furnace wall is provided with a cooling layer. The drying furnace assembly includes a drying-furnace feeding device, a temperature detection device and an automatic control valve. The drying-furnace feeding device is detachably installed inside the coal inlet. The automatic control valve is detachably installed at one end of a coal gas outlet away from the furnace wall. The temperature detection device is installed at an outside of a middle of the furnace wall, and the temperature detection device is connected with the automatic control valve through a heat-resistant hose.

8 Claims, 7 Drawing Sheets

(51) Int. Cl.
*C10J 3/42* (2006.01)
*C10J 3/74* (2006.01)
*C10J 3/82* (2006.01)

(52) U.S. Cl.
CPC ..... *C10J 3/42* (2013.01); *C10J 2200/09* (2013.01); *C10J 2200/152* (2013.01); *C10J 2200/36* (2013.01); *C10J 2300/093* (2013.01); *C10J 2300/1838* (2013.01)

(58) Field of Classification Search
CPC ..... C10J 2300/0956; C10J 2300/0959; C10J 2300/0909; C10J 3/723; C10J 3/74; C10J 2300/1846; C10J 3/78; C10J 2200/152; C10J 2300/0976; C10J 3/66; C10J 3/72; C10J 3/32; C10J 3/82; C10J 2200/36; C10J 3/42
See application file for complete search history.

(56) References Cited

U.S. PATENT DOCUMENTS 4,658,791 A * 4/1987 Absenger ..... F02B 7/02 123/446
6,047,906 A * 4/2000 Plager ..... B05B 1/323 239/533.2
11,268,029 B1 * 3/2022 Regnery ..... C10J 3/72
2002/0179742 A1 * 12/2002 Yildirim ..... F02M 61/047 239/533.3
2007/0012229 A1 * 1/2007 Rehmat ..... F23J 15/006 110/229
2010/0107642 A1 * 5/2010 Bhaisora ..... C10J 3/506 60/737
2011/0139906 A1 * 6/2011 Burger ..... F02M 47/027 239/569
2011/0179712 A1 * 7/2011 Thacker ..... F01K 23/067 48/202
2013/0056563 A1 * 3/2013 Schmieder ..... F02M 55/00 239/585.1
2014/0008913 A1 * 1/2014 Akiyama ..... C01B 3/52 422/162
2014/0102547 A1 * 4/2014 Maffeis ..... B25J 15/04 285/124.1
2019/0072331 A1 * 3/2019 Yamamoto ..... C10J 3/485
2022/0220398 A1 * 7/2022 Sakamoto ..... C10B 49/06

FOREIGN PATENT DOCUMENTS

CN 103320171 A 9/2013
CN 114752419 A 7/2022
JP H11228975 A 8/1999

* cited by examiner

DRYING FURNACE DEVICE OF GASIFIER CAPABLE OF AUTOMATICALLY ADJUSTING TEMPERATURE

CROSS-REFERENCE TO RELATED APPLICATIONS

This application is a continuation of PCT/CN2023/094787, filed on May 17, 2023 and claims priority of Chinese Patent Application No. 202210534546.X, filed on May 17, 2022, the entire contents of which are incorporated herein by reference.

TECHNICAL FIELD

The application relates to the technical field of coal gasifiers, and in particular to a drying furnace device of a gasifier capable of automatically adjusting temperatures.

BACKGROUND

The purpose of drying the gasifier is to make the furnace wall dry to a certain extent, so as to prevent the furnace wall from cracking due to moisture of furnace walls and uneven expansion after sudden heating during boiler operation. In addition, drying is also able to make the mortar joint of the furnace wall reach better strength and improve the high temperature resistance of the furnace wall.

At present, there are two main methods for drying gasifiers, namely, the flame drying method and steam drying method. When drying, the heating curve should be determined according to various boiler models, whether it is a light furnace wall or a heavy furnace wall, the local and current climate conditions and other factors, and the furnace should be dried according to the determined heating scheme. Attention should be paid to drawing the heating curve and storing it in the boiler technical file.

During the drying process, it is necessary to always pay attention to avoiding the indication difference between the upper and lower thermocouples in the gasifier combustion cavity, and the maximum and minimum temperature difference should be controlled within 100° C., otherwise the furnace wall may be cracked. However, it is difficult for the drying furnace device to keep the internal temperature of the gasifier even on the market at present, and the accuracy of controlling drying temperature is not enough.

SUMMARY

The application uses high-temperature steam to dry the gasifier, and aims to provide a drying furnace device of a gasifier capable of automatically adjusting temperature, so as to solve the problems raised in the above background technology:

At present, it is difficult for the baking device on the market to keep the internal temperature of the gasifier even, and the drying temperature control accuracy is not enough.

A drying furnace device of a gasifier capable of automatically adjusting temperature includes the gasifier and a drying furnace assembly. The gasifier includes a furnace wall. The top of the furnace wall is provided with a coal inlet, the top side of the furnace wall is provided with a coal gas outlet, and the outside of the bottom of the furnace wall is provided with a cooling layer. The drying furnace assembly includes a drying-furnace feeding device, a temperature detection device and an automatic control valve. The drying-furnace feeding device is detachably installed inside the coal inlet.

The automatic control valve is detachably installed at one end of the coal gas outlet away from the furnace wall. The temperature detection device is installed an outside of a middle of the furnace wall, and the temperature detection device is connected with the automatic control valve through a heat-resistant hose. The inside of the heat-resistant hose is filled with liquid with obvious thermal expansion cooling effects and high temperature resistance.

Optionally, the drying-furnace feeding device includes a fixed ring. The fixed ring is movably connected with the coal inlet. A steam pipe is inserted in the middle of the fixed ring. The bottom of the steam pipe penetrates into the inside of the furnace wall. The top of the steam pipe is connected with a high-temperature steam conveying device. A protective sleeve is sleeved outside the upper half of the steam pipe. A control sleeve is sleeved outside the lower half of the steam pipe. The top of the control sleeve is fixedly provided with a spring A, and the top of the spring A is fixedly connected with the top inner wall of the protective sleeve, and the outsides of the control sleeve and the steam pipe are both provided with air-outlet holes.

Optionally, when the spring A is relaxed, the air-outlet holes on surfaces of the steam pipe and the control sleeve are not coincident, but when the spring A is extended, the air-outlet holes on the surfaces of the steam pipe and the control sleeve are coincident.

Optionally, the temperature detection device includes a fixed part and a movable part. The fixed part is fixedly installed on the outside of the furnace wall, and a heat-conducting metal rod A is fixedly arranged inside the fixed part. The movable part may be movably connected with the fixed part, and a heat-conducting metal rod B is inserted into one end of the movable part close to the fixed part. When the fixed part is connected with the movable part, the heat-conducting metal rod A is closely attached to the heat-conducting metal rod B. A heat-resistant hose is arranged at one end of the movable part away from the fixed part, and an adjusting valve is arranged at the top of the movable part.

Optionally, the automatic control valve includes a valve body. The radius of the middle of the valve body is larger than the radiuses of both ends of valve body, and the inner walls of both ends of the valve body are both fixedly provided with fixed rods. The middle of the valve body is divided into two cavities. One cavity close to the coal gas outlet is a sealed cavity, and one cavity away from the coal gas outlet is a gas transmission cavity. The radius of the gas transmission cavity is larger than the radius of the sealed cavity.

Optionally, a movable piston is fitted inside the sealed cavity, and the middle of the movable piston is provided with a hole and a middle shaft is inserted in the hole. One end of the middle shaft is fixedly connected with one of fixed rods close to the coal gas outlet. The outside of the middle shaft is sheathed with a spring B, and both ends of the spring B are respectively fixedly connected with the one of fixed rods close to the coal gas outlet and the movable piston.

Optionally, the inside of the gas transmission cavity is in frictional contact with a rotating ring, and the outside of the rotating ring is fixedly provided with a stopper. The inner wall of the valve body is provided with a groove for the stopper to move. One end of the rotating ring away from the coal gas outlet is connected with a bearing. A rotating shaft is inserted in the middle of the bearing. The rotating shaft is connected with one of fixed rods away from the coal gas outlet. An arc-shaped groove is provided on the inner wall of the valve body. The bottom of the arc-shaped groove communicates with the heat-resistant hose, and a movable block is movably arranged inside the arc-shaped groove. The movable block is fixedly connected with the stopper.

Optionally, the radius of the rotating ring is larger than the radius of the movable piston. One end of the movable piston close to the rotating ring is fixedly provided with an insertion part. The end of the rotating ring close to the movable piston is provided with an insertion hole, and the position of the rotating ring close to the edge of the rotating ring is provided with a plurality of air leakage holes.

Optionally, when the rotating ring is in the normal position, the insertion hole and the insertion part are not coincident. When the rotating ring rotates for a certain angle, the insertion hole and the insertion part are coincident.

Optionally, the furnace wall is made of refractory bricks. A grate is arranged on the inner wall of the bottom of the furnace wall. Support legs are fixedly connected to the outside of the bottom of the furnace wall, and a furnace bottom is arranged in the middle of the bottom of the furnace wall.

Optionally, a steam outlet and a safety valve are respectively arranged at both ends of the top of the cooling layer, and a cooling water inlet is arranged at the outside of the middle of the cooling layer.

The present application has following beneficial effects.

Compared with the prior art, the application has following advantages.

Firstly, according to the application, the drying-furnace feeding device is designed to feed the high-temperature steam uniformly, so that everywhere inside the gasifier is able to be uniformly contacted with the high-temperature steam, and everywhere inside the gasifier are uniformly heated, so as to prevent everywhere inside the furnace wall from cracking due to uneven heating.

Secondly, the temperature detection device transfers the temperature inside the gasifier to the mercury inside the heat-resistant hose, and then the mercury expands when heated, and automatically controls the opening and closing of the automatic control valve according to the temperature of the liquid.

Thirdly, through the design of the fixed part and the movable part, the device is able to be quickly installed and disassembled, and the mercury in the movable part is able to be squeezed into the heat-resistant hose by adjusting valve, thus changing the threshold value of the automatic control valve.

DETAILED DESCRIPTION OF THE EMBODIMENTS

In the description of the present application, it should be understood that the orientation or positional relationship indicated by the terms "center", "longitudinal direction", "transverse direction", "length", "width", "thickness", "top", "bottom", "front", "back", "left, right", "vertical", "horizontal", "inner", "outer", "clockwise", "counterclockwise", etc. is based on the orientation or positional relationship shown by the drawings, is only for the convenience of describing the present application and simplifying the description, rather than indicating or implying that the equipment or elements referred to must have a specific orientation, be constructed and operated in a specific orientation, so it cannot be understood as limiting the present application.

In the description of the present application, "plural" means two or more, unless otherwise specifically defined.

In the description of the present application, it should be noted that unless otherwise specified and limited, the terms "installed", "provided", "nested/connected" and "connected" should be broadly understood, such as "connected", which may be fixed connection, detachable connection or integrated connection, or a mechanical connection or an electrical connection, or may be directly connected, may also be indirectly connected through an intermediate medium, and may be intercommunicated between two elements. For those skilled in the field, the specific meanings of the above terms in the present application may be understood in specific situations.

Embodiment 1

Figure 1:
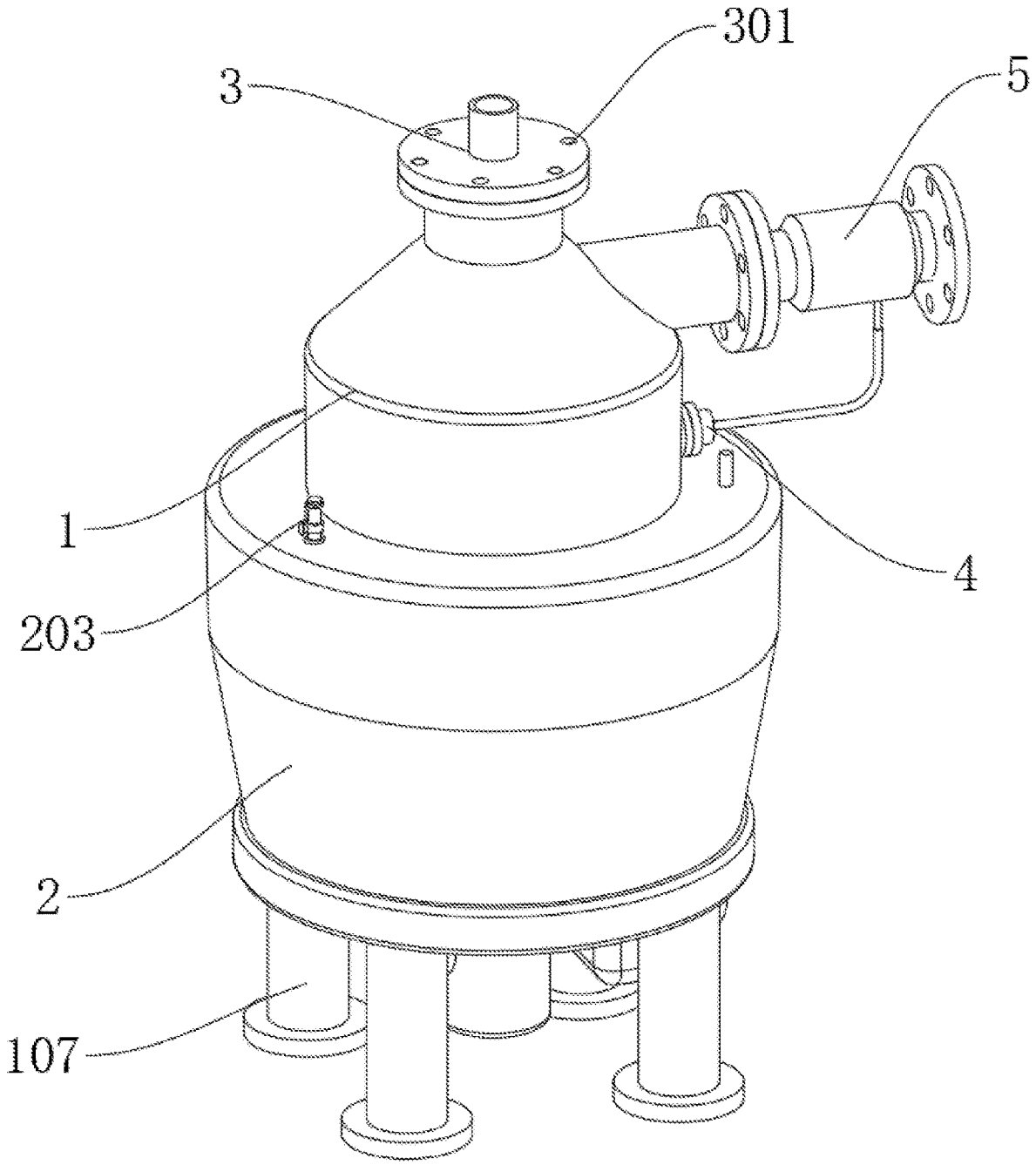
FIG. 1 is an overall schematic diagram of the present application.
Figure 2:
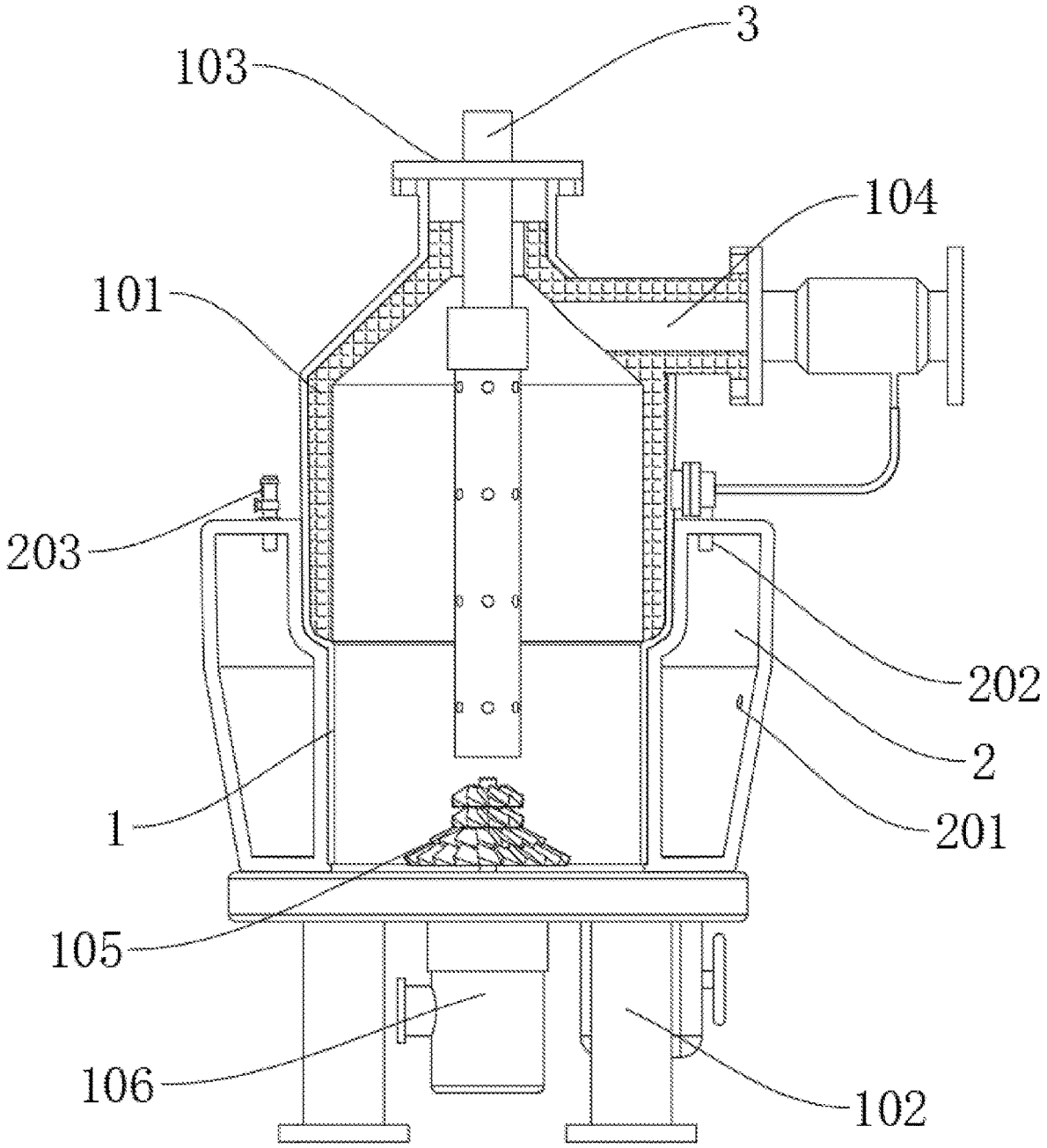
FIG. 2 is a sectional view of the present application.
Figure 3:
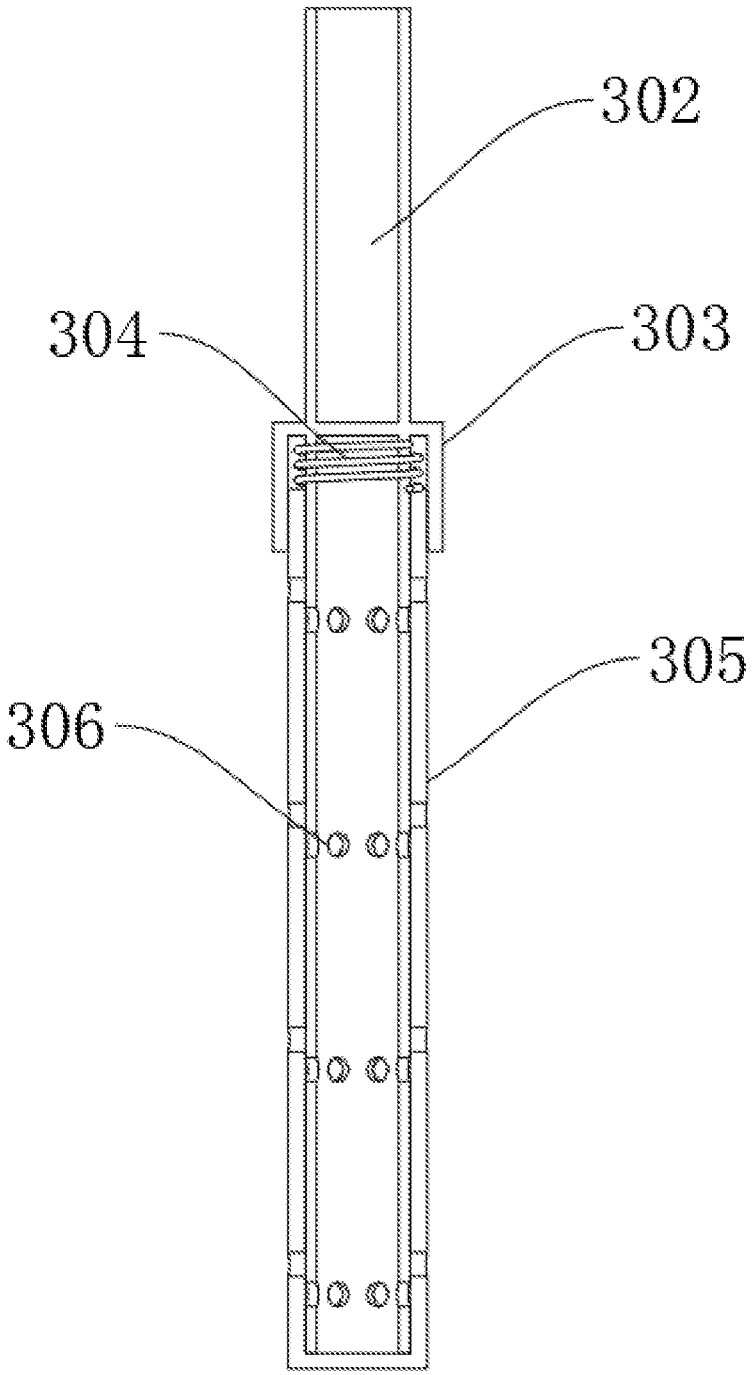
FIG. 3 is a sectional view of a drying-furnace feeding device of the present application.

With reference to FIG. 1-FIG. 3, a drying furnace device of a gasifier capable of automatically adjusting temperature includes a gasifier 1 and a drying furnace assembly. The gasifier 1 includes a furnace wall 101. The top of the furnace wall 101 is provided with a coal inlet 103, the top side of the furnace wall 101 is provided with a coal gas outlet 104, and the outside of the bottom of the furnace wall 101 is provided with a cooling layer 2. The drying furnace assembly includes a drying-furnace feeding device 3, a temperature detection device 4 and an automatic control valve 5. The drying-furnace feeding device 3 is detachably installed inside the coal inlet 103. The automatic control valve 5 is detachably installed at one end of the coal gas outlet 104 away from the furnace wall 101. the temperature detection device 4 is installed outside of a middle of the furnace wall 101, and the temperature detection device 4 is connected with the automatic control valve 5 through a heat-resistant hose 405. The inside of the heat-resistant hose 405 is filled with liquid with obvious thermal expansion cooling effect and high temperature resistance. Because the melting point of mercury is −38.87° C. and the boiling point is 356.6° C., and the thermal expansion and cold contraction of mercury are obvious, mercury is used as the heat conducting liquid here.

The furnace wall 101 is made of refractory bricks. A grate 105 is arranged on the inner wall of the bottom of the furnace wall 101. Support legs 102 are fixedly connected to the outside of the bottom of the furnace wall 101, and a furnace bottom 106 is arranged in the middle of the bottom of the furnace wall 101.

A steam outlet 202 and a safety valve 203 are respectively arranged at both ends of the top of the cooling layer 2, and a cooling water inlet 201 is arranged at the outside of the middle of the cooling layer 2.

The drying-furnace feeding device 3 includes a fixed ring 301. The fixed ring 301 is movably connected with the coal inlet 103. A steam pipe 302 is inserted in the middle of the fixed ring 301. The bottom of the steam pipe 302 penetrates into the inside of the furnace wall 101. The top of the steam pipe 302 is connected with a high-temperature steam conveying device. A protective sleeve 303 is sleeved outside the upper half of the steam pipe 302. A control sleeve 305 is sleeved outside the lower half of the steam pipe 302. The top of the control sleeve 305 is fixedly provided with a spring A 304, and the top of the spring A 304 is fixedly connected with the top inner wall of the protective sleeve 303, and the outsides of the control sleeve 305 and the steam pipe 302 are both provided with air-outlet holes 306.

When the spring A 304 is relaxed, the air-outlet holes 306 on surfaces of the steam pipe 302 and the control sleeve 305 are not coincident, but when the spring A 304 is extended, the air-outlet holes 306 on the surfaces of the steam pipe 302 and the control sleeve 305 are coincident.

When the high-temperature steam is introduced into the inside of the gasifier 1 through the steam pipe 302, air outlets of the steam pipe are completely blocked. At this time, the air pressure inside the steam pipe 302 gradually increases, and the bottom of the control sleeve 305 moves downward under the influence of the air pressure until the air-outlet holes 306 on the surfaces of the steam pipe 302 and the control sleeve 305 are coincident. The high-temperature steam is uniformly ejected from the air-outlet holes 306, so as to make everywhere inside of the gasifier 1 all evenly contact with the high-temperature steam and make everywhere inside of the gasifier 1 evenly heated.

When the air pressure inside the steam pipe 302 decreases, the control sleeve 305 rises under the action of the spring A 304, the air-outlet holes close, and the air pressure inside the steam pipe 302 continues to accumulate, and then the above process is repeated.

Embodiment 2

Figure 4:
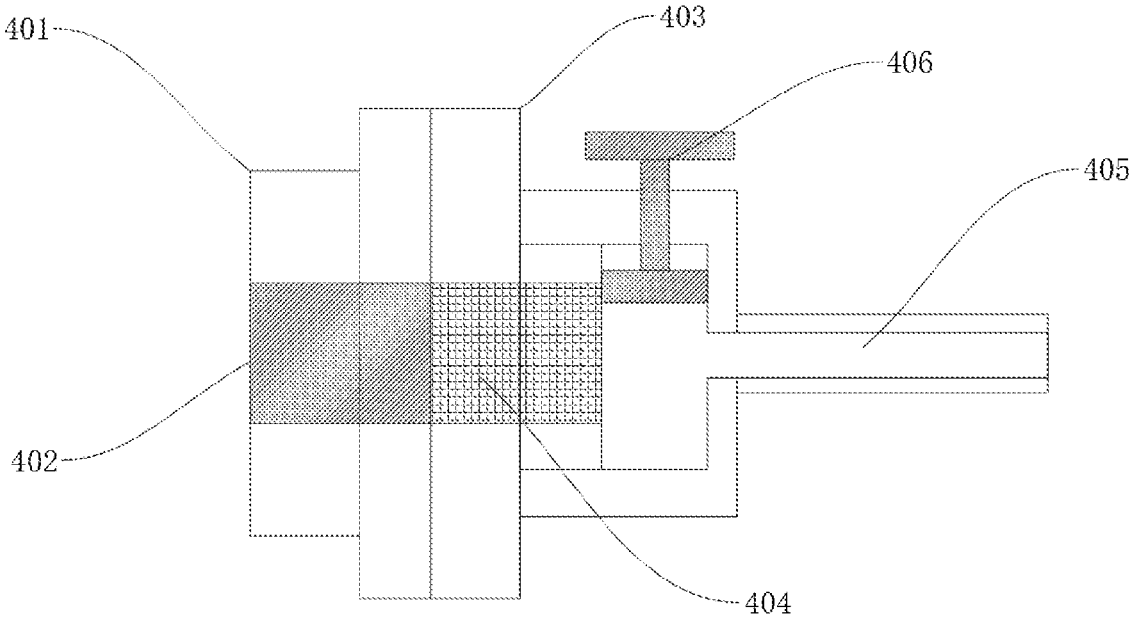
FIG. 4 is a sectional view of a temperature detection device of the present application.

Embodiment 2 differs from Embodiment 1, with reference to FIG. 4 in that temperature detection device 4 includes a fixed part 401 and a movable part 403. The fixed part 401 is fixedly installed on the outside of the furnace wall 101, and a heat-conducting metal rod A 402 is fixedly arranged inside the fixed part 401. The movable part 403 may be movably connected with the fixed part 401, and a heat-conducting metal rod B 404 is inserted into one end of the movable part 403 close to the fixed part 401. When the fixed part 401 is connected with the movable part 403, the heat-conducting metal rod A 402 is closely attached to the heat-conducting metal rod B 404. A heat-resistant hose 405 is arranged at one end of the movable part 403 away from the fixed part 401, and an adjusting valve 406 is arranged at the top of the movable part 403.

The temperature detection device 4 is able to transfer the temperature inside the gasifier 1 to the mercury inside the heat-resistant hose 405, and then the mercury expands when heated, and automatically controls the opening and closing of the automatic control valve 5 according to the temperature of the liquid.

Through the design of the fixed part 401 and the movable part 403, the device is able to be quickly installed and disassembled, and the adjusting valve 406 is able to squeeze the mercury inside the movable part 403 into the heat-resistant hose 405, thus changing the threshold value of the automatic control valve 5.

Embodiment 3

Figure 5:
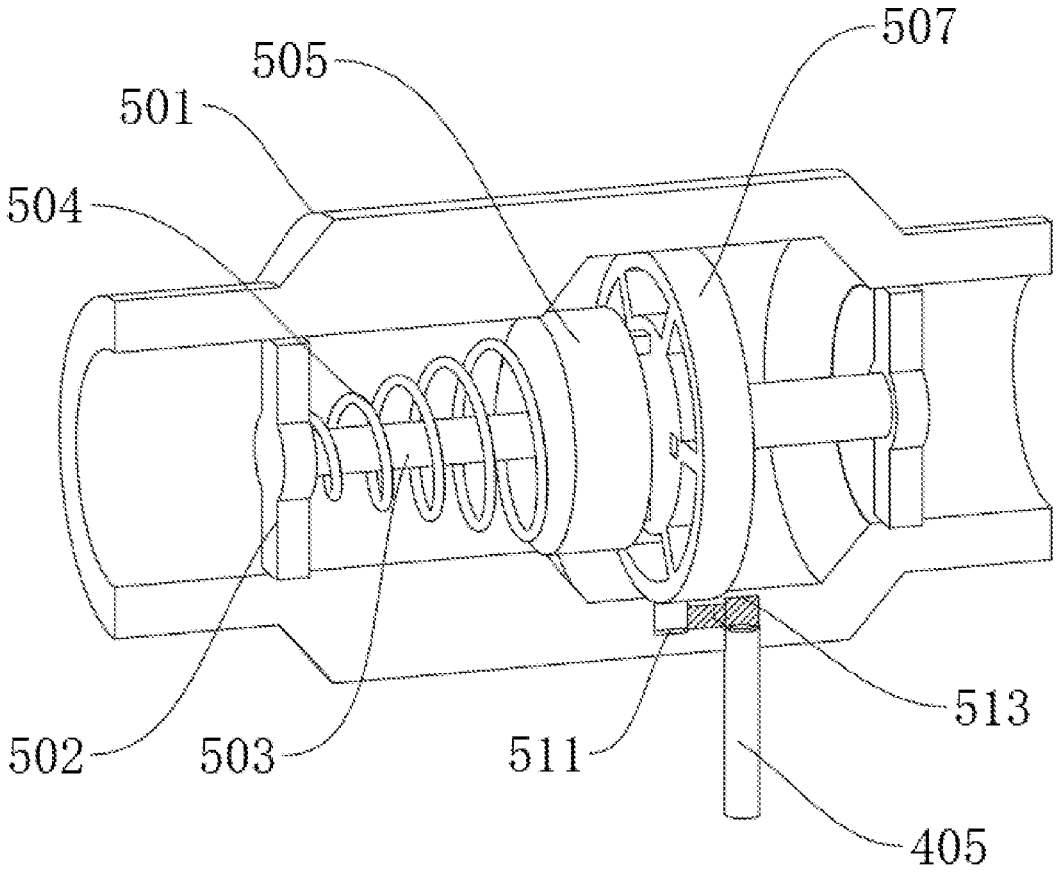
FIG. 5 is a sectional view of an automatic control valve of the present application.
Figure 6:
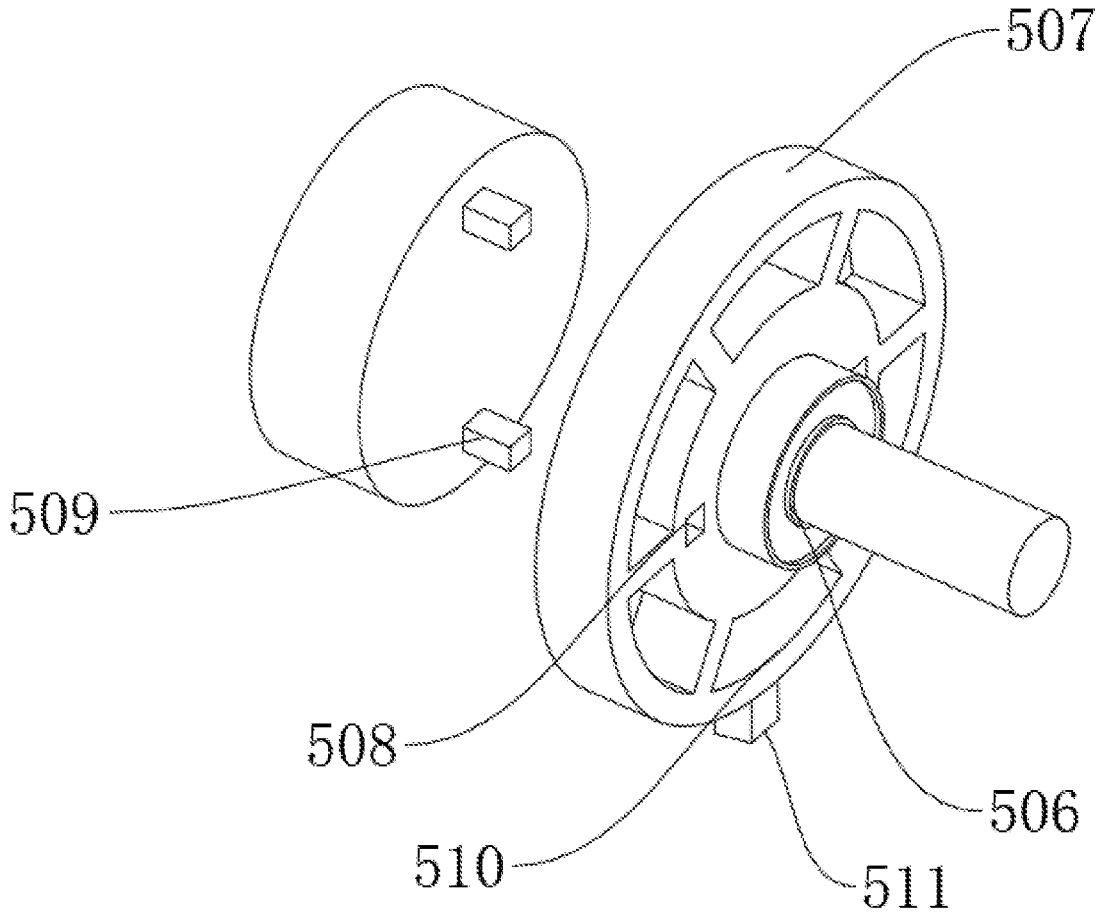
FIG. 6 is a schematic diagram of a movable piston and a rotating ring according to the present application.
Figure 7:
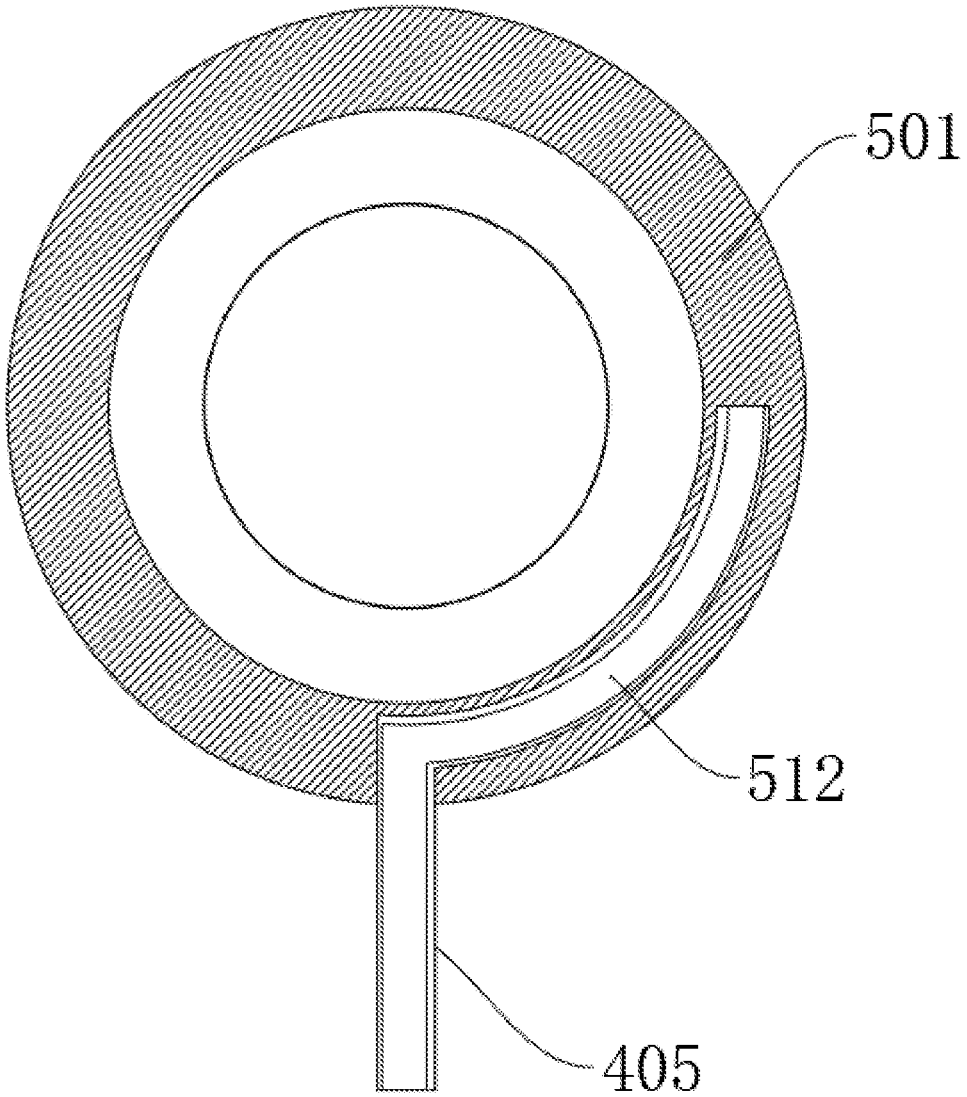
FIG. 7 is a schematic diagram of an arc-shaped groove according to the present application.

Embodiment 3 differs from Embodiment 2 in that, with reference to FIG. 5-FIG. 7, the automatic control valve 5 includes a valve body 501. The radius of the middle of the valve body 501 is larger than the radiuses of both ends of the valve body 501, and the inner walls of both ends of the valve body 501 are both fixedly provided with fixed rods 502. The middle of the valve body 501 is divided into two cavities. One cavity close to the coal gas outlet 104 is a sealed cavity, and one cavity away from the coal gas outlet 104 is a gas transmission cavity. The radius of the gas transmission cavity is larger than the radius of the sealed cavity.

A movable piston 505 is fitted inside the sealed cavity, and the middle of the movable piston 505 is provided with a hole and a middle shaft 503 is inserted in the hole. One end of the middle shaft 503 is fixedly connected with the one of fixed rods 502 close to the coal gas outlet 104. The outside of the middle shaft 503 is sheathed with a spring B 504, and both ends of the spring B 504 are respectively fixedly connected with the one of fixed rods 502 close to the coal gas outlet 104 and the movable piston 505.

The inside of the gas transmission cavity is in frictional contact with a rotating ring 507, and the outside of the rotating ring 507 is fixedly provided with a stopper 511. The inner wall of the valve body 501 is provided with a groove for the stopper 511 to move. One end of the rotating ring 507 away from the coal gas outlet 104 is connected with a bearing 506. A rotating shaft is inserted in the middle of the bearing 506. The rotating shaft is connected with one of fixed rods 502 away from the coal gas outlet 104. An arc-shaped groove 512 is provided on the inner wall of the valve body 501. The bottom of the arc-shaped groove 512 communicates with the heat-resistant hose 405, and a movable block 513 is movably arranged inside the arc-shaped groove 512. The movable block 513 is fixedly connected with the stopper 511. When the mercury in the heat-resistant hose 405 is heated and expanded, the mercury pushes the movable block 513 to move in the arc-shaped groove 512, thus driving the stopper 511 to move, and then driving the rotating ring 507 to rotate.

When the movable piston 505 moves from the sealed cavity to the gas transmission cavity, the high-temperature steam inside the gasifier 1 overflows from the gasifier 1.

The radius of the rotating ring 507 is larger than the radius of the movable piston 505. One end of the movable piston 505 close to the rotating ring 507 is fixedly provided with an insertion part 509. The end of the rotating ring 507 close to the movable piston 505 is provided with an insertion hole 508, and the position of the rotating ring 507 close to the edge of the rotating ring is provided with a plurality of air leakage holes 510.

When the rotating ring 507 is in the normal position, the insertion hole 508 and the insertion part 509 are not coincident. When the rotating ring 507 rotates for a certain angle, the insertion hole 508 and the insertion part 509 are coincident.

When the rotating ring 507 rotates until the insertion hole 508 is coincident with the insertion part 509, the movable piston 505 moves into the gas transmission cavity, and steam overflows. When the air pressure in the gasifier 1 is reduced, the movable piston 505 returns to its original position.

The basic principle, main features and advantages of the present application have been shown and described above. It should be understood by those skilled in the field that the present application is not limited by the above-mentioned embodiments. The above-mentioned embodiments and descriptions are only preferred examples of the present application and are not used to limit the present application. Without departing from the spirit and scope of the present application, there will be various changes and improvements in the present application, which fall within the scope of the claimed application. The scope of the present application is defined by the claim and their equivalents.

What is claimed is:

1. A drying furnace device of a gasifier capable of automatically adjusting temperatures, comprising the gasifier and a drying furnace assembly, wherein the gasifier comprises a furnace wall, a top of the furnace wall is provided with a coal inlet, a top side of the furnace wall is provided with a coal gas outlet, and an outside of a bottom of the furnace wall is provided with a cooling layer, wherein:

the drying furnace assembly comprises a drying-furnace feeding device, a temperature detection device and an automatic control valve, wherein the drying-furnace feeding device is detachably installed inside the coal inlet, the automatic control valve is detachably installed at one end of the coal gas outlet away from the furnace wall, the temperature detection device is installed an outside of a middle of the furnace wall, the temperature detection device is connected with the automatic control valve through a heat-resistant hose, an inside of the heat-resistant hose is filled with liquid and the liquid has a thermal expansion cooling effect and a high temperature resistance;

the temperature detection device is adapted for transmitting temperature inside the gasifier to the liquid inside the heat-resistant hose, and the automatic control valve is automatically controlled to open and close according to a temperature of the liquid through an expansion of the liquid when heated;

the drying-furnace feeding device comprises a fixed ring, the fixed ring is movably connected with the coal inlet, a steam pipe is inserted in a middle of the fixed ring, a bottom of the steam pipe penetrates into an inside of the furnace wall, a top of the steam pipe is connected with a high-temperature steam conveying device, a protective sleeve is sleeved outside an upper half of the steam pipe, a control sleeve is sleeved outside a lower half of the steam pipe, a top of the control sleeve is fixedly provided with a spring A, and a top of the spring A is fixedly connected with a top inner wall of the protective sleeve, and outsides of the control sleeve and the steam pipe are both provided with air-outlet holes;

when the spring A is relaxed, the air-outlet holes on surfaces of the steam pipe and the control sleeve are not coincident, but when the spring A is extended, the air-outlet holes on the surfaces of the steam pipe and the control sleeve are coincident;

when high-temperature steam is introduced into an inside of the gasifier through the steam pipe, air outlets of the steam pipe are completely blocked; air pressure inside the steam pipe gradually increases, and a bottom of the control sleeve moves downward under an influence of the air pressure until the air-outlet holes on the surfaces of the steam pipe and the control sleeve are coincident, the high-temperature steam is uniformly ejected from the air-outlet holes, so as to make everywhere inside of the gasifier all evenly contact with the high-temperature steam and make the everywhere inside of the gasifier evenly heated; and when the air pressure inside the steam pipe decreases, the control sleeve rises under an action of the spring A, the air-outlet holes close, and the air pressure inside the steam pipe gradually increases as above.

2. The drying furnace device of the gasifier capable of automatically adjusting temperatures according to claim 1, wherein the temperature detection device comprises a fixed part and a movable part, the fixed part is fixedly installed on an outside of the furnace wall, and a heat-conducting metal rod A is fixedly arranged inside the fixed part, the movable part is movably connected with the fixed part, and a heat-conducting metal rod B is inserted into one end of the movable part close to the fixed part, when the fixed part is connected with the movable part, the heat-conducting metal rod A is closely attached to the heat-conducting metal rod B, the heat-resistant hose is arranged at one end of the movable part away from the fixed part, and an adjusting valve is arranged at a top of the movable part.

3. The drying furnace device of the gasifier capable of automatically adjusting temperature according to claim 2, wherein the automatic control valve comprises a valve body, a radius of a middle of the valve body is larger than radiuses of both ends of the valve body, and inner walls of the both ends of the valve body are both fixedly provided with fixed rods, the middle of the valve body is divided into two cavities, one cavity close to the coal gas outlet is a sealed cavity, and one cavity away from the coal gas outlet is a gas transmission cavity, a radius of the gas transmission cavity is larger than a radius of the sealed cavity.

4. The drying furnace device of the gasifier capable of automatically adjusting temperatures according to claim 3, wherein a movable piston is fitted inside the sealed cavity, and a middle of the movable piston is provided with a hole and a middle shaft is inserted in the hole, one end of the middle shaft is fixedly connected with one of the fixed rods close to the coal gas outlet, an outside of the middle shaft is sheathed with a spring B, and both ends of the spring B are respectively fixedly connected with one of the fixed rods close to the coal gas outlet and the movable piston.

5. The drying furnace device of the gasifier capable of automatically adjusting temperatures according to claim 4, wherein an inside of the gas transmission cavity is in frictional contact with a rotating ring, and an outside of the rotating ring is fixedly provided with a stopper, an inner wall of the valve body is provided with a groove for the stopper to move, one end of the rotating ring away from the coal gas outlet is connected with a bearing, a rotating shaft is inserted in a middle of the bearing, the rotating shaft is connected with one of the fixed rods away from the coal gas outlet, an arc-shaped groove is provided on the inner wall of the valve body, a bottom of the arc-shaped groove communicates with the heat-resistant hose, and a movable block is movably arranged inside the arc-shaped groove, the movable block is fixedly connected with the stopper.

6. The drying furnace device of the gasifier capable of automatically adjusting temperatures according to claim 5, wherein a radius of the rotating ring is larger than a radius of the movable piston, one end of the movable piston close to the rotating ring is fixedly provided with an insertion part, one end of the rotating ring close to the movable piston is provided with an insertion hole, and a position of the rotating ring close to an edge of the rotating ring is provided with a plurality of air leakage holes; and when the rotating ring is in a normal position, the insertion hole and the insertion part are not coincident; and when the rotating ring rotates for a certain angle, the insertion hole and the insertion part are coincident.

7. The drying furnace device of the gasifier capable of automatically adjusting temperatures according to claim 6, wherein the liquid with the thermal expansion cooling effect and the high temperature resistance is mercury.

8. The drying furnace device of the gasifier capable of automatically adjusting temperatures according to claim 1, wherein a material of the furnace wall is refractory bricks, a grate is arranged on an inner wall of the bottom of the furnace wall, support legs are fixedly connected to the outside of the bottom of the furnace wall, and a furnace bottom is arranged in a middle of the bottom of the furnace wall; and a steam outlet and a safety valve are respectively arranged at both ends of a top of the cooling layer, and a cooling water inlet is arranged at an outside of a middle of the cooling layer.

* * * * *